United States Patent [19]

Nesbitt

[11] 4,052,773

[45] Oct. 11, 1977

[54] BUCKLE

[76] Inventor: Leroy E. Nesbitt, 6213 Gardenia St., Philadelphia, Pa. 19144

[21] Appl. No.: 629,820

[22] Filed: Nov. 7, 1975

[51] Int. Cl.[2] ..... A44B 11/00; A44C 17/02

[52] U.S. Cl. ..... 24/163 K; 40/21 C; 63/29 R

[58] Field of Search ..... 24/163 K, 49 K, 113 MP, 24/211 P; 63/29 R; 40/21 C

[56] References Cited

U.S. PATENT DOCUMENTS

| | | | |
|---|---|---|---|
| 1,052,141 | 2/1913 | Gaschke | 63/29 R |
| 2,537,449 | 1/1951 | Evenson | 63/29 R |
| 2,696,689 | 12/1954 | Speck et al. | 24/265 WS |
| 2,797,462 | 7/1957 | Katzman | 40/21 C |
| 3,039,279 | 6/1962 | Van Bussel | 63/29 R |
| 3,927,442 | 12/1975 | Foster | 24/163 K |

*Primary Examiner*—Paul R. Gilliam
*Assistant Examiner*—Kenneth J. Dorner
*Attorney, Agent, or Firm*—Seidel, Gonda & Goldhammer

[57] ABSTRACT

A buckle adapted for use with a strap means so as to form a belt, bracelet, or the like is disclosed. The buckle includes a housing having a recess on a major face thereof for removably receiving an ornamental member, whereby any one of a plurality of ornamental members may be used with a single housing.

8 Claims, 6 Drawing Figures

FIG. 1
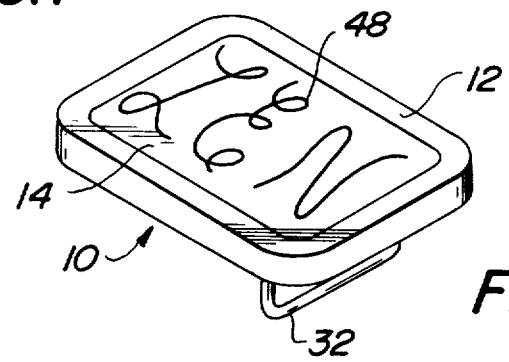
FIG. 2
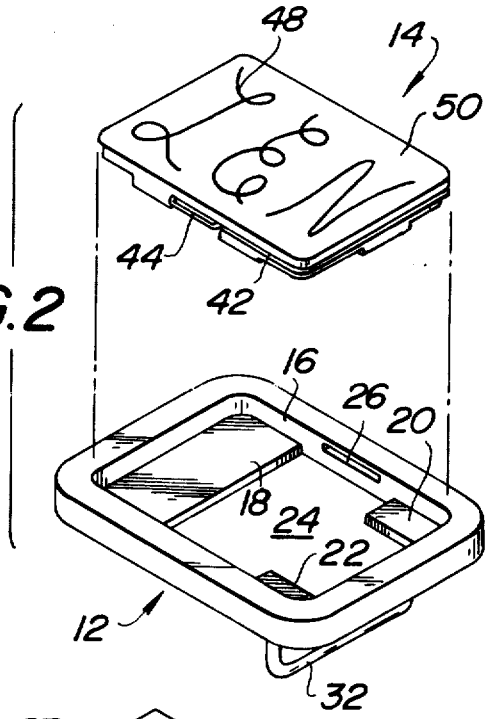
FIG. 3
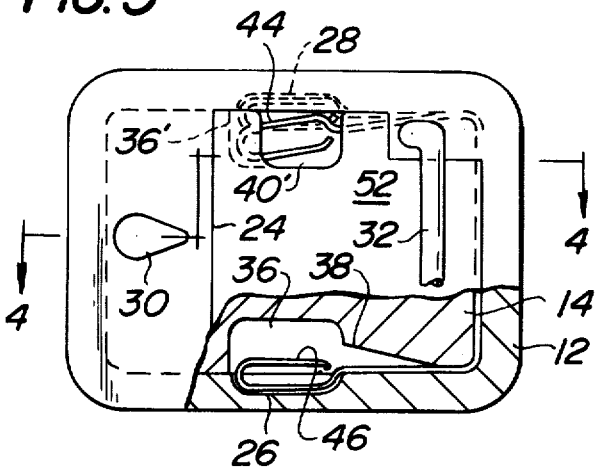
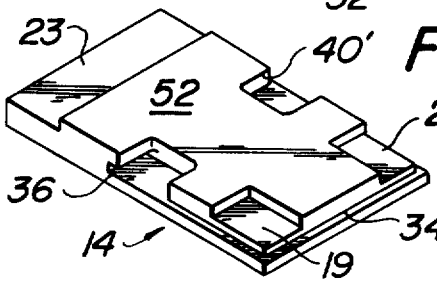
FIG. 6
FIG. 5
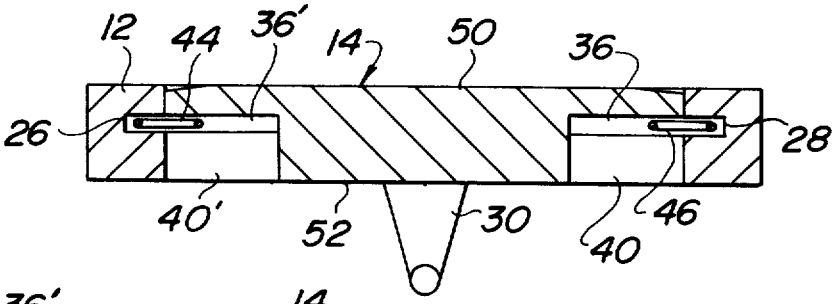
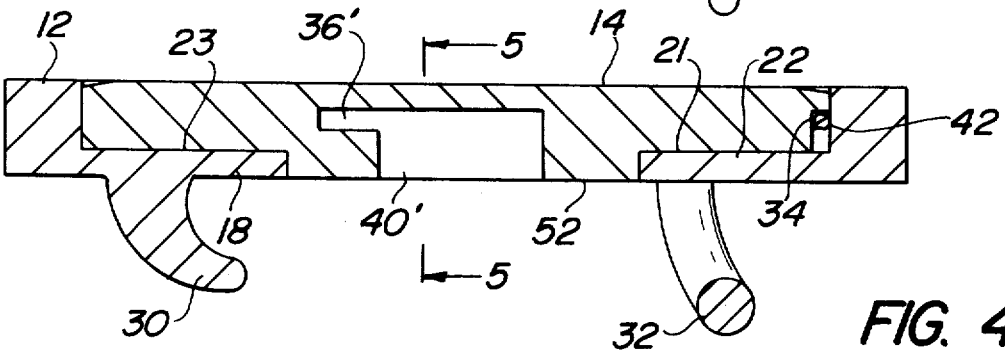
FIG. 4

BUCKLE

BACKGROUND

This invention relates to buckles of the type for use in connection with belts, bracelets, and the like. Representative prior art includes U.S. Pat. Nos. 1,400,666; 2,696,689; and 2,797,462.

The buckle of the present invention includes a housing having a recess on a major face thereof and in which is removably mounted an ornamental member. The ornamental member supports a spring. The spring has at least one loop on the periphery of the ornamental member. The housing has a groove in said recess for receiving a portion of the loop to thereby couple the member to said housing.

The ornamental member has a cavity which is opposite the groove on the housing. A portion of the loop is disposed in each of said groove and cavity. The loop is adapted to be selectively moved into the cavity to facilitate uncoupling of the ornamental member from said housing. In this regard, the cavity in the ornamental member is accessible from a rear surface thereof.

The present invention makes possible a wide variety of buckle designs and styles facilitating easy removal of the ornamental member and substitution of another ornamental member. This is accomplished in a manner whereby the various components of the buckle may be made in any of a wide variety of materials including metal, polymer plastic, ceramics, etc.

It is an object of the present invention to provide a novel buckle having a readily removable ornamental member to facilitate substitution of one member for another.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a perspective view of a buckle in accordance with the present invention.

FIG. 2 is an exploded view of the buckle shown in FIG. 1.

FIG. 3 is a bottom view of the buckle shown in FIG. 1, with portions partially broken away for purposes of illustration.

FIG. 4 is a sectional view taken along the line 4—4 in FIG. 3.

FIG. 5 is a sectional view taken along the 5—5 in FIG. 4.

FIG. 6 is a bottom perspective of the ornamental member.

Referring to the drawing in detail wherein like numerals indicate like elements, there is shown in FIG. 1 a buckle in accordance with the present invention designated generally as 10. The buckle 10 may be used in connection with a belt, a bracelet, or other article of adornment. As will be clear in the description set forth hereinafter, the particular embodiment illustrated in the drawing is of the type adapted to be used with a belt.

The buckle 10 includes a housing 12 which as illustrated is rectangular in configuration. Other configurations may be used in place of a rectangular configuration. The housing 12 removably supports an ornamental member 14. Housing 12 includes a recess 16 on a major face thereof. In the recess 16, the housing 12 is provided with support surfaces 18, 20 and 22. Housing 12 includes an opening 24 which communicates with the recess 16 except for those areas containing the support surfaces 18, 20 and 22 which preferably are at a common elevation.

Within the recess 16, opposite sides of the housing 12 are provided with grooves designated 26 and 28. The grooves 26 and 28 are located at an elevation approximately equidistant from the upper surface of the support surfaces 18, 20, 22 and the uppermost surface of the housing 12. As shown in FIG. 5, the grooves 26 and 28 are blind grooves.

The housing 12 is provided with attachment means thereon for attaching the housing to other structure preferably in the form of a strap or bracelet. The attachment means includes a prong 30 and a belt loop 32 which are adapted to cooperate with the ends of a belt in a conventional manner. The prong 30 and loop 32 are on the bottom surface of the body 12. As will be apparent from FIG. 3, the support surface 18 is integral with the prong 30 while the ends of the loop 32 are integral with one of the support surfaces 20, 22.

The body 12 may be made from any one of a wide variety of materials including metal, polymer plastic, ceramic, glass, etc. The body 12 may be cast in one piece or may be comprised of several components which are secured together in any convenient manner such as by welding.

The ornamental member 14 is generally flat with recesses 19, 21 and 23 on its bottom surface 52. Each of the recesses on the bottom surface 52 cooperates with one of the support surfaces 18, 20 and 22. The thickness of member 14 corresponds generally to the thickness of the body 12 as will be apparent from FIG. 5.

The ornamental member 14 is provided with a peripheral groove 34. See FIGS. 2 and 4. Groove 34 extends along one end surface and partially along opposite side faces to the cavities 36, 36'. The cavities 36, 36' are on opposite sides of the member 14. Each of the cavities 36, 36' is preceded by a tapered portion 38. See FIG. 3. Member 14 is provided with a access hole 40 communicating with recess 36 and with a access hole 40' communicating with cavity 36'. See FIG. 5.

A U-shaped spring 42 is provided. The free ends of the spring 42 terminates in loops 44, 46. The spring 42 is accommodated in and supported by the groove 34 on the member 14. Loop 46 partially extends into groove 26 and partially extends into recess 36. Loop 44 partially extends into groove 28 and partially extends into recess 36'. Access to manipulate the loop such as loop 44 whereby it is disposed entirely within the recess 36' is accomplished by way of access hole 40'.

The upper surface of the ornamental member 14 may receive any one of a wide variety of different types of ornamentation such as the ornamentation shown in FIGS. 1 and 2 wherein letters 48 are applied to the uppermost surface of member 14. The ornamentation may be painted on, applied by way of decals, may be in the form of surface relief, or may in the form of other configurations and designs which are applied to the uppermost surface 50 of the member 14. It will be noted from FIGS. 4 and 5 that the uppermost surface 50 of member 14 is substantially flush with the uppermost surface of body 12. Likewise, the bottom surface 52 of member 14 is substantially flush with the bottom surface of body 12.

The buckle is utilized as follows. One end of a strap or bracelet is connected to loop 32 and the other end is connected to the prong 30. When it is desired to change the ornamental insert member 14, it is only necessary to reach into one or both of the access holes 40, 40' with an object or one's finger and displace the loop so that it is disposed entirely within the cavity 36 or 36'. Thereafter, pressure applied to the bottom surface 52 will cause the member 14 to be removed from the body 12. Any other ornamental member 14 may be substituted therefor.

It is to be noted that the retention of the ornamental member 14 within the recess 16 is attained by the loops 44, 46. Hence, the strength of the body 12 and/or the ornamental member 14 does not enter into the retension of the ornamental member 14. As a result thereof, the body 12 and/or the ornamental member 14 may be made from materials having very low strength or relatively fragile. Further, it will be noted that the entire buckle is comprised of only three components, namely the body, the ornamental member and the spring. While the body 12 and ornamental member 14 are shown as being rectangular, they may have other shapes such as circular, triangular, hexagon, etc. Ornamental member 14 need only conform to the shape of the recess 16 but need not conform to the outer peripheral shape of the body 12.

The present invention may be embodied in other specific forms without departing from the spirit or essential attributes thereof and, accordingly, reference should be made to the appended claims, rather than to the foregoing specification as indicating the scope of the invention.

I claim:

1. A buckle comprising a body having front and rear major faces with a recess on one major face thereof, said body having an opening therethrough and communicating with said recess, said body having means defining a support means in said recess adjacent the periphery of said opening, an ornamental member having front and rear major faces disposed in said recess and removably coupled to said body and supported by said support means, said body having at least one groove communicating with said recess and said member having at least one cavity opposite said groove, a spring having at least one portion partially disposed in said cavity and said groove, means defining an access hole in a major face of and said ornamental member, said access hole being accessible from the exterior of said body when said ornamental member is supported by said support means, said access hole communicating with one of said cavity and said groove to facilitate movement of the spring from said groove to said cavity to thereby facilitate uncoupling of said member from said body and attachment means for facilitating attaching the buckle to a support structure.

2. A buckle in accordance with claim 1 wherein said means defining an access hole is in said rear major face of said ornamental member, said hole being aligned with said cavity.

3. A buckle in accordance with claim 1 wherein said spring has a pair of loops, said loops being on opposite sides of said ornamental member, said body having a groove in said recess on opposite sides thereof, each groove receiving at least a portion of one of said loops.

4. A buckle in accordance with claim 1 wherein said spring is U-shaped with loops at its free ends, said loops being on opposite sides of said ornamental member, each loop overlying the interface between said member and an adjacent portion of said body.

5. A buckle in accordance with claim 1 wherein said spring is supported by said ornamental member, said means defining an access hole being a hole in said ornamental member aligned with said cavity adjacent a side edge of said ornamental member.

6. A buckle in accordance with claim 1 wherein said ornamental member has a portion disposed within said opening, the thickness of said member being approximately the same as the thickness of said body.

7. A buckle in accordance with claim 1 wherein said attachment means is on said rear major face of said body and wherein said supporting structure is a strap.

8. A buckle in accordance with claim 7 wherein said attachment means comprises a loop and a prong.

* * * * *